United States Patent [19]

Nakajima et al.

[11] Patent Number: 4,819,440

[45] Date of Patent: Apr. 11, 1989

[54] SLIDING-VANE ROTARY COMPRESSOR WITH DISPLACEMEMT-ADJUSTING MECHANISM, AND CONTROLLER FOR SUCH VARIABLE DISPLACEMENT COMPRESSOR

[75] Inventors: Nobuyuki Nakajima; Shigeru Okada, both of Konan, Japan

[73] Assignee: Diesel Kiki Co., Ltd., Tokyo, Japan

[21] Appl. No.: 96,410

[22] Filed: Sep. 15, 1987

[30] Foreign Application Priority Data

Sep. 25, 1986 [JP] Japan ..... 61-227056
Feb. 19, 1987 [JP] Japan ..... 62-37167

[51] Int. Cl.[4] ..... B60H 1/32; F25B 1/00

[52] U.S. Cl. ..... 62/133; 62/209; 62/228.3; 62/228.5; 62/230; 62/243

[58] Field of Search ..... 62/209, 228.5, 229, 62/228.1, 228.3, 230, 243, 244, 133, 228.4, 323.4

[56] References Cited

U.S. PATENT DOCUMENTS 4,132,086 1/1979 Kountz ..... 62/209
4,226,090 10/1980 Horian ..... 62/133
4,561,260 12/1985 Nishi et al. ..... 62/133 X
4,698,977 10/1987 Takahashi ..... 62/133

*Primary Examiner*—Harry B. Tanner
*Attorney, Agent, or Firm*—Wenderoth, Lind & Ponack

[57] ABSTRACT

A sliding-vane rotary compressor includes a first control valve responsive to the pressure in a low pressure chamber for adjusting the rate of communication between a high pressure side and a low pressure side, and a second control valve operative in the same manner as the first control valve under the control of an external signal. With this construction, an optimum displacement control of the compressor is achieved. Also disclosed is an apparatus for controlling a variable displacement compressor, in which a solenoid valve is controlled depending on internal and external thermal load conditions of the compressor for selectively blocking fluid communication between high and low pressure sides.

6 Claims, 9 Drawing Sheets

SLIDING-VANE ROTARY COMPRESSOR WITH DISPLACEMEMT-ADJUSTING MECHANISM, AND CONTROLLER FOR SUCH VARIABLE DISPLACEMENT COMPRESSOR

FIELD OF THE INVENTION

The present invention relates to a sliding-vane rotary compressor suitable for use in an automotive air conditioning system and including a mechanism for adjusting displacement thereof. It also relates to an apparatus for controlling such variable displacement compressors.

RELATED ART

There are known various adjustment mechanisms incorporated in a sliding-vane rotary compressor for adjusting displacement thereof. One example of such known mechanisms is disclosed in Japanese Patent Application No. 61-142600 filed in the name of the present assignee. The disclosed mechanism is of the internal control type which comprises an adjustment member rotatably mounted on a side block and angularly movable in either direction in response to a difference between the bias of a spring and the pressure in the pressure chamber. The pressure chamber receives a metered flow of high pressure gas and is held in flow communication with a low pressure chamber through a connecting passage. The open area of the connecting passage is adjusted by a control valve which is operative in response to the pressure in the low pressure chamber When the speed or r.p.m. of the compressor becomes high, the pressure in the low pressure chamber decreases whereupon the control valve opens the connecting passage, thereby lowering the pressure in the low pressure chamber With this pressure drop, the adjustment member is then turned, under the force of the spring, in one direction to increase displacement of the compressor. On the contrary, when the r.p.m. of the compressor is dropped, the adjustment member is turned in the opposite direction, thereby reducing displacement of the compressor.

With this arrangement, displacement of the compressor is controlled in dependence on the pressure in the low pressure chamber. This control system however is not well adaptable to external conditional changes. For instance, it is desired to reduce displacement of the compressor when an automobile is accelerated, however, pressure drop in the low pressure chamber which leads to the desired reduction of displacement occurs only after the automobile has accelerated.

Typical examples of known variable displacement compressors are disclosed in Japanese Patent Application Nos. 60-160760 and 60-268137 both filed in the name of the present assignee. The disclosed compressor comprises a cylinder closed at its opposite ends by side blocks, a rotor rotatably disposed in the cylinder, and vanes slidably received in radial grooves formed in the rotor. One of the side blocks in which an intake port is provided has a by-pass port. There are defined between the side blocks, cylinder, rotor and vanes a plurality of compartments which vary in volume to compress a working fluid while the rotor is in rotation. The compressors further include a pair of pressure chambers defined in the one side block and communicating respectively with a low pressure chamber side and a high pressure chamber side, an adjustment member for adjusting open area of the by-pass port, and an on-off valve mechanism for varying the pressure in the respective pressure chambers. The adjustment member is operative in response to a change in pressure in each pressure chamber to adjust the open area of the by-pass port, thereby controlling the compression starting timing (i.e. amount of fluid to be compressed). Thus the displacement of the compressor is adjustably controlled.

The on-off valve mechanism of the known compressors comprises a control valve including a ball valve element disposed on one end of a bellows. The bellows detects and is responsive to a change of the intake pressure Ps as a factor of internal thermal loads for effecting the internal control of the displacement of the compressor. In place of the bellows, the on-off valve mechanism may be composed of a solenoid-operated valve. The solenoid valve is responsive to a change in operating speed of the compressor detected through the detection of a factor of external thermal loads, such as an engine r.p.m. or a temperature of refrigerant gas blown-off from an evaporator, for effecting the external control of the displacement of the compressor. The pressure in the respective pressure chambers is changed by such valve mechanism, in response thereto the adjustment member is operated to adjust the open area of the by-pass port, thereby adjustably controlling the displacement of the compressor.

The internal control using the bellows is not satisfactory in that a lower displacement is not always realized in accelerating condition, and the bellows, as it deforms, causes a time lag or delay in controlling operation. Accordingly, it is difficult to achieve a fine control of the compressor and its power source. Likewise, the conventional external control using the solenoid valve requires detection by various sensors of internal and external thermal load conditions; otherwise the resulting control of compressor would not follow up a fine conditional change in an air conditioning system in which the compressor is incorporated.

SUMMARY OF THE INVENTION

It is therefore an object of the present invention to provide a sliding-vane rotary compressor incorporating structural features which enable an optimum displacement control well adapted to both internal and external changes.

Another object of the present invention is to provide a controller for variable displacement compressors which is simple in construction and capable of effecting a fine control of the compressor.

A further object of the present invention is to provide an apparatus for controlling a variable displacement compressor reliably without causing objectionable delay in controlling operation.

According to a first aspect of the present invention, there is provided a sliding-vane rotary compressor including a displacement-adjusting mechanism, the compressor comprising:

a rotor slidably carrying thereon a plurality of radial vanes and rotatably disposed in a space defined by a cylinder and a pair of side blocks disposed on opposite ends of the cylinder;

means defining a plurality of compression chambers which are variable in volume with each revolution of the rotor, the chamber-defining means including the cylinder, rotor, side blocks and vanes, the compression chambers being defined by the cylinder, rotor, side blocks and vanes;

an adjustment member rotatably disposed in one of the side blocks for adjusting a compression starting position;

resilient means for urging the adjustment member to turn in one direction;

means defining a pressure chamber communicating with a high pressure chamber through an orifice for producing a pressure acting on the adjustment member to urge the latter in the opposite direction against the force of the resilient means;

a first control valve operative in response to the pressure in a low pressure chamber for adjusting the rate of communication between the pressure chamber and the low pressure chamber; and a second control valve operative in response to an external signal to adjust the rate of communication between the pressure chamber and the low pressure chamber.

With this construction, displacement of the compressor is controlled in response to both internal and external changes. The internal control effected by the first control valve is simple but insufficient per se. This deficiency of the internal control is however compensated by the external control achieved by the second control valve. An optimum system is thus realized.

According to a second aspect of the present invention, there is provided an apparatus for controlling a variable displacement compressor, which comprises:

electric on-off means for selectively blocking the communication between a low pressure chamber and a high pressure chamber in the compressor;

sensor means for detecting internal and external thermal load conditions for controlling operation of the compressor; and control means for controlling operation of the electric on-off means on the basis of the internal and external thermal load conditions detected by the sensor means.

With this construction, both internal and external displacement controls of the compressor are effected by a single controller. Thus, the apparatus as a whole is simple in construction.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
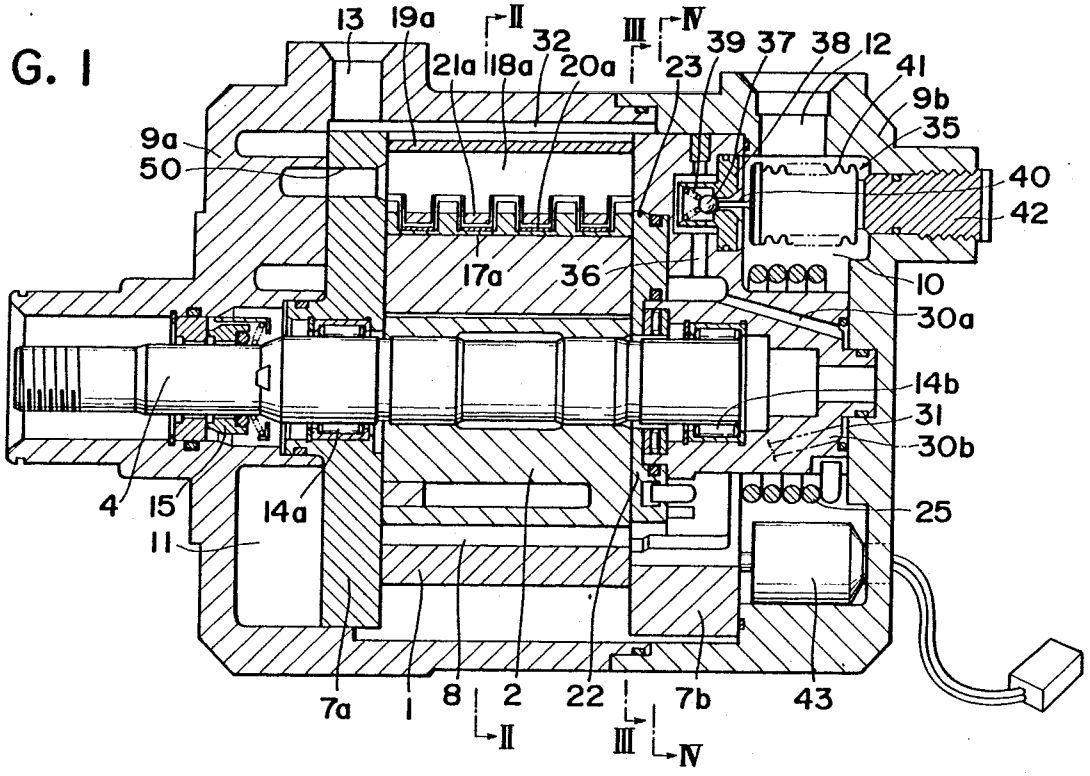
FIG. 1 is a longitudinal cross-sectional view of a sliding-vane rotary compressor including a displacement varying mechanism according to the present invention.
Figure 2:
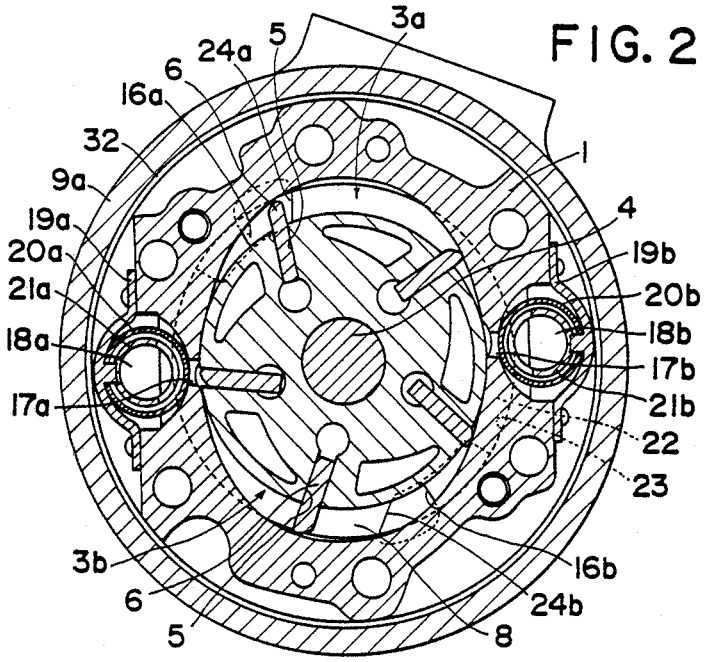
FIG. 2 is a cross-sectional view taken along line II—II of FIG. 1.

As shown in FIGS. 1 through 4, a sliding-vane rotary compressor embodying the present invention includes a cylinder 1 and a rotor 2 rotatably disposed in a substantially elliptical bore in the cylinder 1. The rotor 2 is sealingly engageable with the inner wall of the cylinder 1 along a minor axis of the elliptical bore so that there are defined between the rotor 2 and the cylinder 1 two operating spaces 3*a*, 3*b* disposed in symmetric relation to one another. The rotor 2 is fixedly mounted on a drive shaft 4 and includes a plurality (five in the illustrated embodiment) of approximately radial slots 5 in which vanes 6 are slidably inserted, respectively.

A pair of front and rear side blocks 7*a*, 7*b* is secured to opposite ends of the cylinder 1 and held in sliding contact with the rotor 2 and the vanes 6. Thus, there are five compression chambers 8 defined between the cylinder 1, rotor 2, vanes 6 and side blocks 7*a*, 7*b*.

A pair of generally cup-shaped front and rear shells 9*a*, 9*b* is coupled together at open one end thereof and they extend circumferentially around the cylinder 1 and the side blocks 7*a*, 7*b*. The rear side block 7*b* and the rear shell 9*b* define a low pressure chamber 10 therebetween, and the front side block 7*a* and the front shell 9*a* define a high pressure chamber 11 therebetween. The low pressure chamber 10 is connected with an intake port 12 formed in the shell 9*b*, while the high pressure chamber 11 is connected with a discharge port 13 formed in the shell 9*a*.

The drive shaft 4 is rotatably supported by the side blocks 7*a*, 7*b* via a pair of radial bearings 14*a*, 14*b*. The drive shaft 4 includes an end portion extending in a hollow cylindrical end portion of the front shell 9*a* for being coupled with an engine drive shaft, not shown, to receive the engine torque therefrom. A mechanical seal 15 is disposed between the end portion of the drive shaft 4 and the front shell 9*a*.

The rear side block 7*a* has a pair of intake holes 16*a*, 16*b* defined therein in symmetric relation and brought to communication with the low pressure chamber 10 when the respective compression chambers 8 increase in size. The position of trailing ends of the intake holes 16*a*, 16*b* relative to the compression chambers 8, that is the compression starting position is adjusted by an adjustment member described later on. A plurality (two in the illustrated embodiment) of discharge holes 17*a*, 17*b* are formed in the cylinder 1 in diametrically opposite relation and they communicate respectively with a pair of valve-receiving chambers 18*a*, 18*b*. The valve-receiving chambers 18*a*, 18*b* are defined by and between the cylinder 1 and a pair of arcuate covers 19*a*, 19*b* secured thereto and they receive respectively therein a pair of roll-shaped delivery valves 20*a*, 20*b* and a corresponding number of stoppers 21*a*, 21*b* associated with the delivery valves 20*a*, 20*b* to restrict the movement of the valves 20*a*, 20*b*. The delivery valves 20*a*, 20*b* and the stoppers 21*a*, 21*b* are retained on the covers 19*a*, 19*b*. The valve-receiving chambers 18*a*, 18*b* communicate with the high pressure chamber 11 through a delivery passage 50 extending through the front side block 7*a*.

Figure 5:
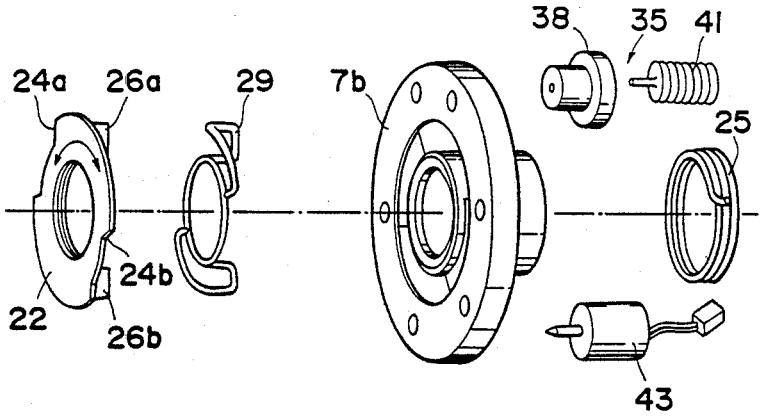
FIG. 5 is an exploded perspective view of a portion of the compressor.

An adjustment member 22 is of a ring-like shape as best shown in FIG. 5, and it is rotatably fitted in an annular groove 23 formed in the rear side block 7*b*. The adjustment member 22 has a pair of cut-out recesses 24*a*, 24*b* normally held in communication with the respective intake holes 16*a*, 16*b* in the rear side block 7*b*. With this arrangement, the circumferential position of the cut-out recesses 24*a*, 24*b* varies with angular movement of the adjustment member 22 so that it is possible to adjust the compression starting position or the position in which the vanes 6 begins to block fluid communication between the compression chambers 8 and the intake holes 16*a*, 16*b*.

Figure 3:
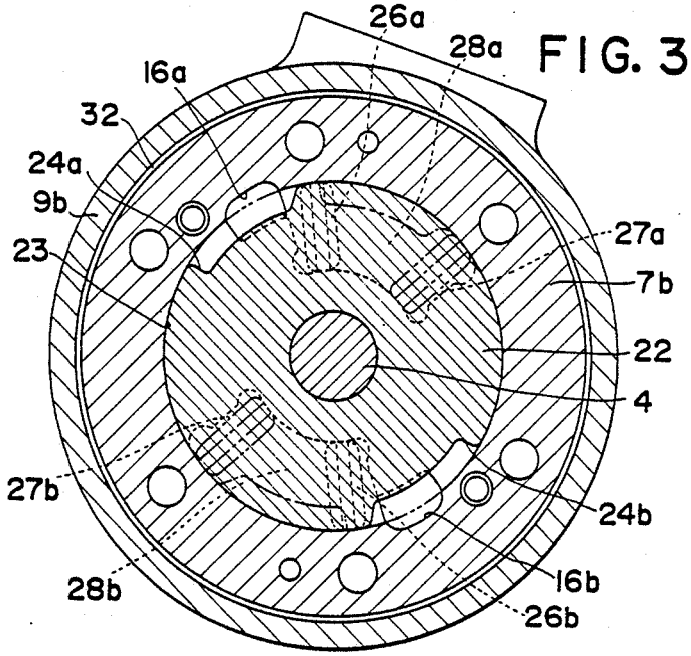
FIG. 3 is a cross-sectional view taken along line III—III of FIG. 1.
Figure 4:
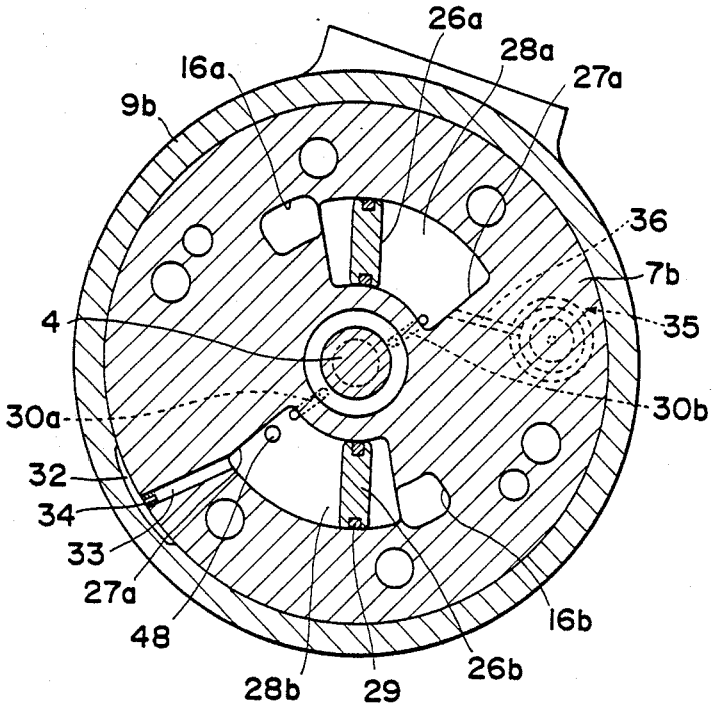
FIG. 4 is a cross-sectional view taken along line IV—IV of FIG. 1.

A torsion coil spring 25 constituting a resilient urging or biasing means is resiliently disposed and acting between the rear side block 7*b* and the adjustment member 22 for urging the latter to turn in the clockwise direction in FIGS. 3 and 4. The adjustment member 22 includes a pair of tongue-like pressure-retaining portions 26*a*, 26*b* projecting perpendicularly from the body of the adjustment member 22. The pressure-retaining portions 26*a*, 26*b* are slidably received in a pair of guide grooves 27*a*, 27*b*, respectively, formed in the side block 7*b* and extending contiguously from the intake holes 16*a*, 16*b*. Thus, there are two pressure chambers 28*a*, 28*b* defined between the guide grooves 27*a*, 27*b* and the adjustment member 22. The pressure chambers 28*a*, 28*b* are sealed from the outside by means of a seal member 29 which is fitted over the inner and outer peripheral edges of the adjustment member 22 and the periphral edges of the pressure-retaining portions 26*a*, 26*b*. The pressure chambers 28*a*, 28*b* communicate with each other through a pair of connecting holes 30*a*, 30*b* extending through the side block 7*b* and through a connecting space 31 defined between the side block 7*b* and the shell 9*b*. One of the pressure chambers 28*b* is held in fluid communication with the high pressure chamber 11 via a first high pressure guide passage 32 and a second high pressure guide passage 33. The first high pressure guide passage 32 is defined between the cylinder 1, side blocks 7*a*, 7*b* and shells 9*a*, 9*b* while the second high pressure guide passage 33 extends in the side block 7*b*. The second high pressure guide passage 33 includes an orifice 34 for supplying a metered flow of discharge gas therethrough to the pressure chamber 28*b*.

A first control valve 35, as shown in FIGS. 1, 4 and 5, is provided for adjusting the rate of communication between the low pressure chamber 10 and the pressure chambers 28*a*, 28*b* in response to the pressure in the low pressure chamber 10. The control valve 35 includes a ball valve element 37 and a first valve seat 38 for retaining the valve element 37, the valve element 37 and the valve seat 38 being disposed in a first connecting passage 36 extending in fluid communication between the low pressure chamber 10 and the pressure chambers 28*a*, 28*b*. The valve element 37 is urged by a valve spring 39 in a direction to contact with the valve seat 38. The valve element 37 is joined with one end of a valve stem 40 the other end of which is connected to a bellows 41. The bellows 41 is disposed in the low pressure chamber 10 and flexibly deformable in response to the pressure in the low pressure chamber 10. The bellows 41 contracts with the pressure increase in the low pressure chamber 10 while it extends with the pressure reduction in the low pressure chamber 10. The sensibility of the bellows 41 is adjustably set by an adjustment screw 42.

Figure 6:
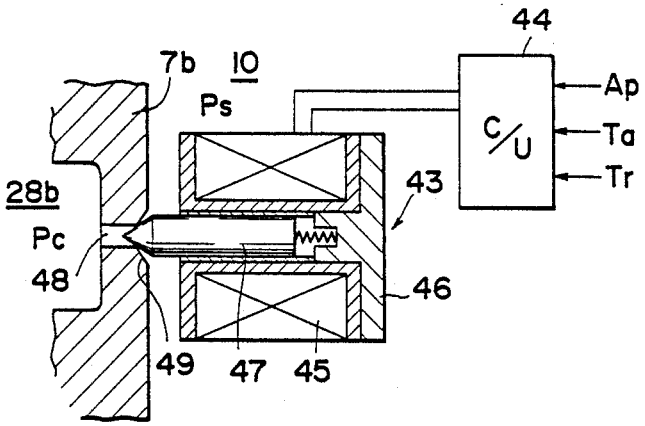
FIG. 6 is cross-sectional view of a second control valve incorporated in the compressor.

As shown in FIG. 6, a second control valve 43 is constituted by a solenoid valve and includes an exciting coil 45 wound around a stator 46 for magnetizing the stator 46 when an exciting current is supplied to the exciting coil 45 in response to a control signal fed from a control unit 44, and a needle valve element 47 movably mounted on the stator 46. The needle valve element 47 is disposed in confronting relation to a second connecting passage 48 defined in the side block 7*b* and extending in fluid communication between the low pressure chamber 10 and the pressure chamber 28. One end of the connecting passage 48 is flared to provide a second valve seat 49 against which a front end of the needle valve element 47 is seated. The control unit 44 receives input signals respectively representing the rate of acceleration Ap of an automobile, the temperature Tr of a vehicle compartment, and the temperature Ta of outside air and it computes a control signal on the basis of the input signals.

With this construction, when the drive shaft 4 is driven to rotate the rotor 2 in one direction, the vanes 6 slide along the inner wall of the cylinder 1 to cause the compression chambers 8 to subsequently increase and decrease in size with each revolution of the rotor 2. As the compression chambers 8 increase in size or volume, two compression chambers 8 are brought to fluid communication with the low pressure chamber 10 through the intake holes 16*a*, 16*b* and the cut-out recesses 24*a*, 24*b* of the adjustment member 22, whereupon a gas which has been introduced from the intake port 12 into the low pressure chamber 10 is drawn into the compression chambers 8 through the intake holes 16*a*, 16*b* and the cut-out recesses 24*a*, 24*b*. Then the compression chambers 8 gradually decrease in size, however, compression of the gas does not take place because the gas flows back into the low pressure chamber 10 through the cut-out recesses 24*a*, 24*b* and the intake holes 16*a*, 16*b* until the succeeding two vanes 6 move past one end of the cut-out recesses 24*a*, 24*b*, whereupon the gas is trapped in the compression chambers 8 and compression is commenced. A further movement of the rotor 2 causes the preceding two vanes 6 to move past the discharge holes 17*a*, 17*b* whereupon the delivery valves 20*a*, 20*b* are forced to be open by the pressure in the compression chambers 8. Consequently, the compression chambers 8 are brought into fluid communication with the valve-receiving chambers 18*a*, 18*b*. The gas in the compression chambers 8 is discharged through the discharge holes 17*a*, 17*b* into the valve-receiving chambers 18*a*, 18*b*, then flows through a delivery connecting groove 50 into the high pressure chamber 11, and finally is discharged from the discharge port 13 to the outside of the compressor.

Operation of the displacement-adjusting mechanism is described below in detail. When the vehicle is cruising at low speed, the pressure Ps in the low pressure chamber 10 is high. In this condition, the bellows 41 of the first control valve 35 is kept contracted to thereby reduce the open area between the valve element 37 and the first valve seat 38. Consequently, so long as the connecting passage 48 is constantly metered or restricted by the second control valve 43, the pressure Pc in the pressure chambers 28*a*, 28*b* increases to a value approximately equal to the pressure Pd in the high pressure chamber 11. With this pressure rise, the adjustment member 22 is caused to turn counterclockwise against the bias of the spring 25, thereby advancing the compression starting timing or the timing when the succeeding vanes 6 close the cut-out recesses 24*a*, 24*b*. The compressor is thus driven at a large displacement.

When the engine is driven at high speed, the pressure Ps in the low pressure chamber 10 is low. Consequently, the bellows 41 of the first control valve 35 extends to thereby increase the open area between the valve element 37 and the valve seat 38. Under such condition, the pressure Pc in the pressure chambers 28*a*, 28*b* is lowered to a value close to the pressure Ps in the low pressure chamber so long as the second connecting passage 48 is constantly restricted by the second control valve 43. With this pressure drop, the adjustment member 22 is caused to turn clockwise under the force of the spring 25 with the result that the timing when the cut-out recesses 24*a*, 24*b* are closed by the succeeding vanes 6, i.e. the compression starting timing is retarded.

The second control valve 43 is normally supplied with a small current supply to its exciting coil 45 so that the needle valve element 47 is kept in a position slightly spaced from the second valve seat 49. Consequently, a very small amount of gas is allowed to flow from the pressure chambers 28*a*, 28*b* to the low pressure chamber 10. With this leakage, the pressure Pc in the pressure chambers 28*a*, 28*b* is normally lower than the pressure Pd in the high pressure chamber 11. When the vehicle is speeding or accelerated, an acceleration signal Ap is fed to the control unit 44 which in turn increases the current supply to the exciting coil 45, thereby enlarging the open area of the second connecting passage 48. As a result, the pressure Pc in the pressure chambers 28*a*, 28*b* is lowered even when the first connecting passage 36 is blocked by the first control valve 35. With this pressure drop, the adjustment member 22 is turned clockwise to lower displacement of the compressor with the result that the engine load is lowered and hence the acceleration efficiency is increased.

In case the temperature Ta of outside air is low and the temperature Tr of a vehicle compartment is high to the contrary, current supply from the control unit 44 to the exciting coil 45 is interrupted, whereupon the second control valve 43 completely blocks the second connecting passage 48. The foregoing temperature condition occurs when the compressor is running to remove moisture while cooling air in the cab. In this instance, if the compressor is operating without blocking the second connecting passage 48, the first control valve 35 will be opened as thermal load on the evaporator is low. As a result, the pressure in the pressure chambers 28*a*, 28*b* is lowered to such an extent to become nearly equal to the pressure in the low pressure chamber 10. The compressor is then driven substantially in non-loaded condition and hence the desired dehumidification cannot be achieved. According to the present invention, however, the second connecting passage 48 is fully blocked by the second control valve 43 so that the pressure in the pressure chambers 28*a*, 28*b* is increased to such an extent that the compressor is driven at a predetermined displacement volume sufficient to effect dehumidification as desired.

In addition to the foregoing temperature condition, various other conditions not specified above may be used to control the second control valve 43. For instance, the second control valve 43 may be controlled in the per se known manner to satisfy any one of the following conditions: When the vehicle is going up along a slope, the displacement of the compressor is lowered; When a brake pedal is stepped an to decelerate the vehicle, the displacement is increased; When slippage occurs in a belt drive mechanism transmitting the drive force from the engine to the compressor, the displacement is reduced; and when the temperature of discharge gas in the compressor is excessively increased, the displacement is lowered.

A description is given for a controller for adjustably controlling displacement of a variable displacement compressor, the controller including the second control valve 43 composed of a solenoid valve.

Figure 7:
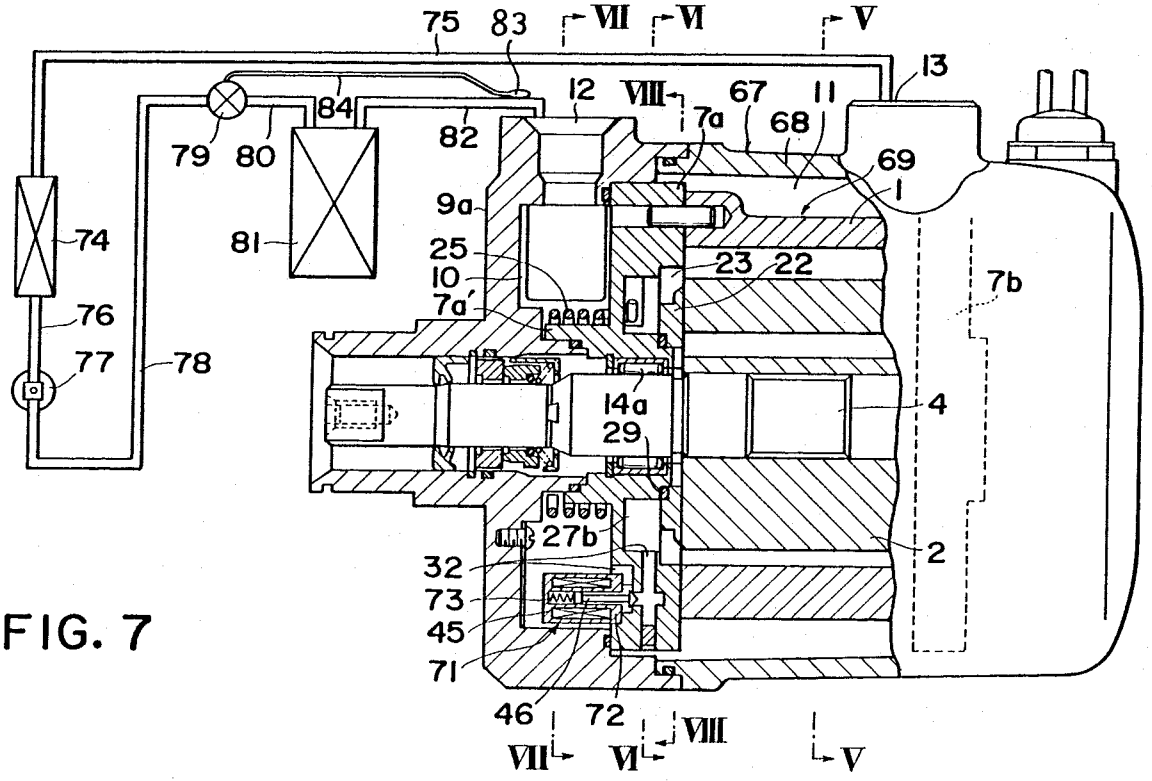
FIG. 7 is a schematic view showing the general construction of a refrigeration cycle incorporating a sliding-vane rotary compressor employed in a controller for variable displacement compressors according to the present invention.

FIG. 7 shows the general construction of a refrigeration cycle in which a sliding-vane rotary compressor (variable displacement compressor) is incorporated. The compressor includes a housing 67 composed of a tubular casing 68 opening at one end and a shell 9*a* connected by bolts (not shown) to the casing 68 so as to close the open end of the casing 68. The casing 68 has a discharge port 13 disposed on the rear side thereof and extending through an upper wall of the casing 68 for discharging a refrigerant gas acting as a heat transferring medium. The shell 9*a* has a refrigerant gas intake port 12 formed in an upper wall thereof. The discharge port 13 and the intake port 12 are held in fluid communication with a high pressure chamber 11 and a low pressure chamber 10, respectively.

The housing 67 contains a compressor body 69 which essentially comprises a cylinder 1, a pair of side blocks 7*a*, 7*b* connected to the cylinder 1 to close the opposite open ends of the cylinder 1, a substantially cylindrical rotor 2 rotatably disposed in the cylinder 1, and a drive shaft 4 connected to the rotor 2 for rotating the latter. The drive shaft 4 is rotatably supported by a pair of radial bearings 14*a* (only one appearing with the side block 7*a*) mounted in the respective side blocks 7*a*, 7*b*.

Figure 8:
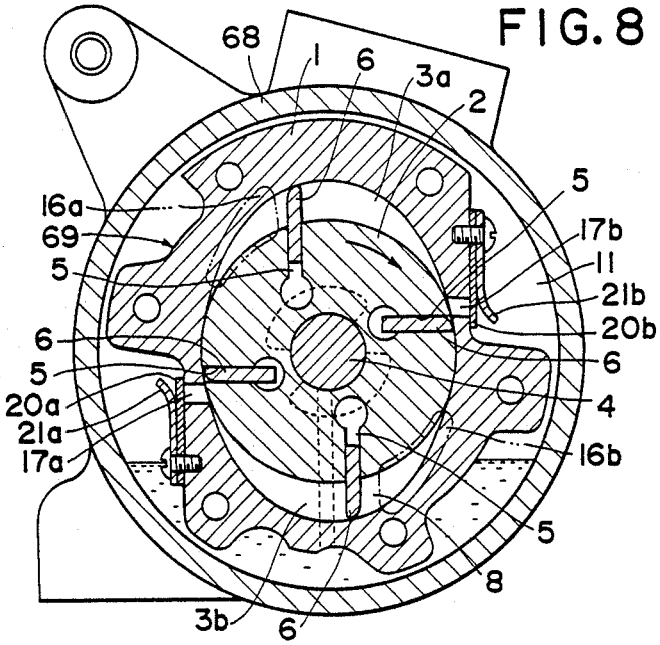
FIG. 8 is a cross-sectional view taken along line V—V of FIG. 7.

As shown in FIG. 8, the cylinder 1 includes an elliptical inner wall which defines jointly with the outer peripheral wall of the rotor 2 a pair of operating spaces 3*a*, 3*b* disposed in diametrically opposite symmetrical relation.

The rotor 2 has a plurality (four in the illustrated embodiment) of radial slots 5 circumferentially spaced at equal angular intervals, and vanes 6 movably inserted in the respective slots 5.

The side block 7*a* has a pair of diametrically opposite symmetrical intake holes 16*a*, 16*b*, as shown in FIGS. 8 through 11. The intake holes 16*a*, 16*b* are located at respective positions in which compression chambers 8, which are defined by and between the cylinder 1, rotor 2, vanes 6 and side blocks 7*a*, 7*b*, becomes maximum in volumetric size. The intake holes 16*a*, 16*b* extend through the thickness of the side block 7*a* so that the compression chambers 8 are communicatable through the intake holes 16*a*, 16*b* with a low pressure chamber 10 defined between the shell 9*a* and the side block 7*a*.

The cylinder 1 has a pair of discharge holes 17*a*, 17*b* extending through its confronting peripheral wall portions and connecting therethrough the compression chambers 8 and a high pressure chamber 11 which is defined in the casing 68. The discharge holes 17*a*, 17*b* have disposed therein a pair of delivery valves 20*a*, 20*b* and associated stoppers 21*a*, 21*b*.

Figure 11:
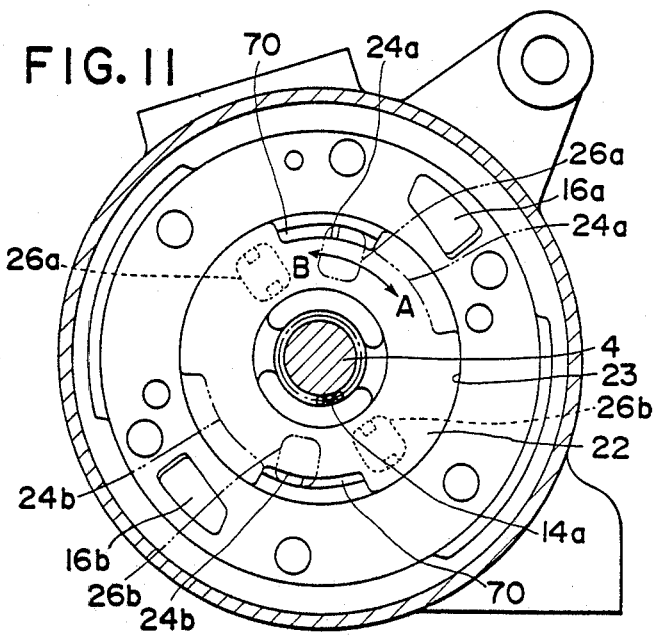
FIG. 11 is a cross-sectional view taken along line VIII—VIII of FIG. 7.

The side block 7a, as shown in FIG. 11, has formed in its one surface an annular groove 23 facing the rotor 2. The groove 23 has a pair of arcuate by-pass ports 70, 70 disposed in diametrically opposite symmetrical relation for connecting therethrough the compression chambers 8 and the low pressure chamber 10. The open area of the by-pass ports 70, 70 is adjusted by a ring-like adjustment member 22 which is rotatably fitted in the annular groove 23 and is angularly movable in either direction. The adjustment member 22 includes a pair of cut-out recesses 24a, 24b extending arcuately along the outer peripheral edge thereof and disposed in diametrically opposite symmetrical relation. The adjustment member 22 further includes a pair of integral tongue-like pressure-retaining portions 26a, 26a extending from one of its opposite surfaces and disposed in diametrically opposite symmetrical relation. The pressure-retaining portions 26a, 26a are slidably fitted in a pair of arcuate guide grooves 27a, 27b. With the pressure-retaining portions 26a, 26b, the guide grooves 27a, 27b are each divided into first and second pressure chambers 28a, 28a'; 28b, 28b' disposed on opposite sides of the corresponding pressure-retaining portion 26a, 26b. The first pressure chambers 28a, 28b communicate with the low pressure chamber 10 via the intake holes 16a, 16b and the by-pass ports 70. One of the second pressure chambers (Pc chamber) 28a' communicates with the high pressure chamber 11 via an orifice 34. The second pressure chambers 28a', 28b' are held in communication with each other via a connecting passage 30. The orifice 34 is disposed between the second pressure chamber 28a' and the high pressure chamber 11.

A seal member 29 of a specific design is fitted over a central portion of one surface of the adjustment member 22 and also over opposite edges of each of the pressure-retaining portions 26a, 26b. With this seal member 29, there are provided hermetic seals between the first and second pressure chambers 28a, 28a'; 28b, 28b' and between the central portion of the adjustment member 22 and a central portion of the annular groove 23 in the side block 7a.

The adjustmemt member 22 is urged by a biasing means composed of a spring 25 to turn in one direction (counterclockwise direction in FIG. 11) to enlarge the open area of the by-past ports 70. The spring 25 is fitted around a central cylindrical boss 7a' extending from the side block 7a toward the low pressure chamber 10. The spring 25 is connected at one end to the central boss 7a' and at the other end to the adjustment member 22.

Figure 9:
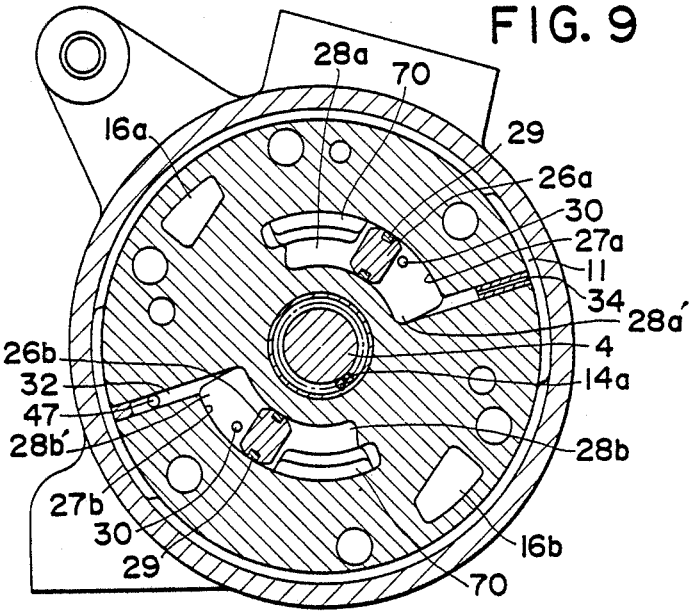
FIG. 9 is a cross-sectional view taken along line VI—VI of FIG. 7.
Figure 10:
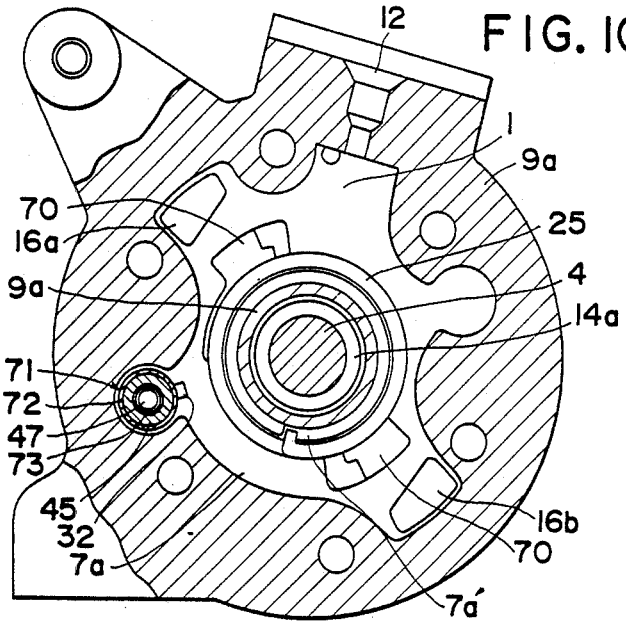
FIG. 10 is a cross-sectional view taken along line VII—VII of FIG. 7.

The second pressure chamber 28b', as shown in FIG. 9, is held in communication with the low pressure chamber 10 via a first high pressure guide passage 32 in which a solenoid valve (on-off means) 71 is disposed. The valve 71 is opened upon energization and includes a housing 72, an exciting coil 45 disposed in the housing 72, a needle valve element 47 movable to open and close the first high pressure guide passage 32, and a valve spring 73 for urging the needle valve element 47 in a direction to close the valve. In response to energization and de-energization of the exciting coil 45, the needle valve element 47 of the solenoid valve 71 opens and closes the first high pressure guide passage 32 to thereby selectively make and block the communication between the low pressure chamber 10 and the high pressure chamber 11 through the first high pressure guide passage 32, the second pressure chamber 28b', the connecting passage 30, the second pressure chamber 28a, and the orifice 34.

The sliding-vane rotary compressor constitutes part of the refrigeration system or cycle shown in FIG. 7. To this end, the discharge port 13 of the compressor is connected through a line 75 to the inlet of a condenser 74, the outlet of which is connected to the inlet of an expansion valve 79 successively through a line 76, a reservoir 77 and a line 78. The outlet of the expansion valve 79 is connected via a line 82 to the inlet of an evaporator 81, the outlet of which is connected via a line 82 to the intake port 12 of the compressor. The expansion valve 79 is connected through capillary tube 84 to a thermo-sensing tube 84 closely juxtaposed on the line 82 at the outlet side of the evaporator 81.

Figure 12:
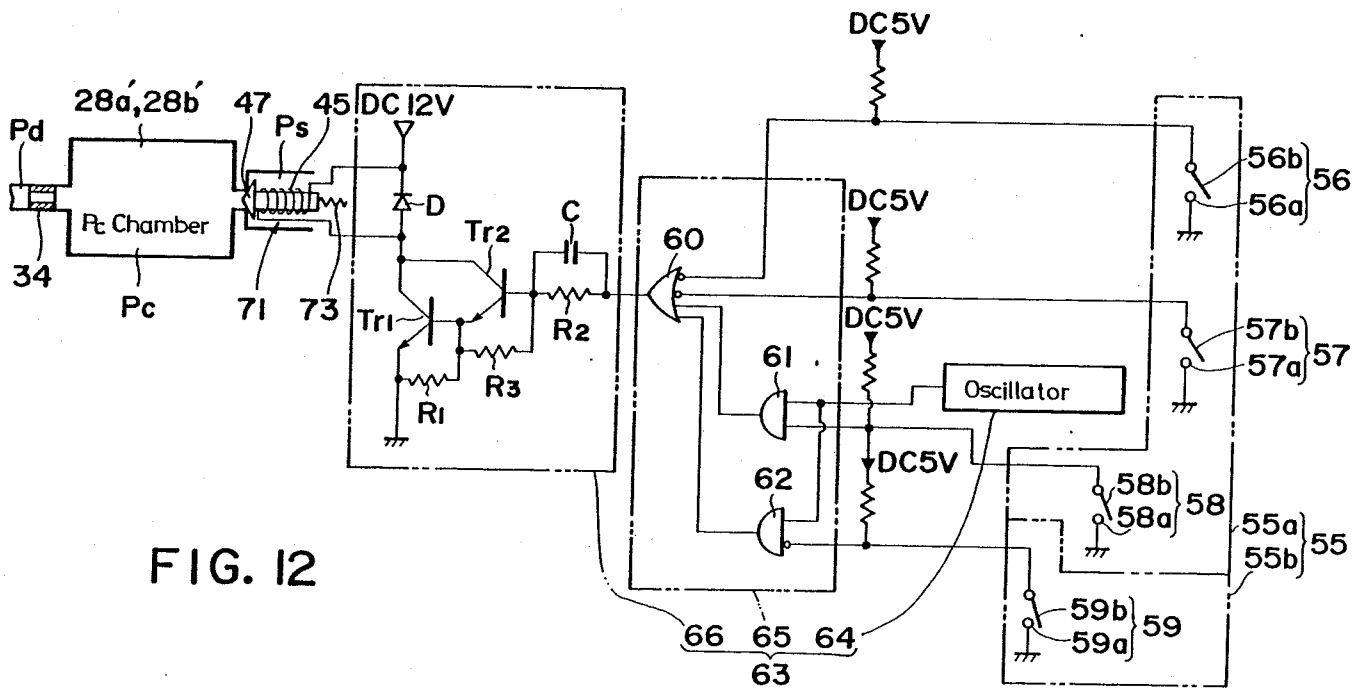
FIG. 12 is a block diagram showing a controller according to one embodiment.

FIG. 12 is a block diagram showing a controller, wherein the reference numeral 55 denotes a sensor means for detecting both external and internal thermal load conditions of the air conditioning system including a power source of the compressor. The sensor means 55 is composed of an external sensor means 55a for detecting the external thermal load conditions, and an internal sensor means 55b for detecting the internal thermal load conditions. The external sensor means 55a comprises an engine cooling water temperature switch 56, an accelerator switch 57 and an evaporator outlet switch 58. The engine water temperature switch 56 is disposed in a device for cooling an engine (not shown) and is adapted to be turned on when the temperature of engine cooling water exceeds a preset value. The accelerator switch 57 is disposed adjacent to an accelerator pedal (not shown) and is adapted to be turned on when the step-in or depressing angle exceeds a predetermined value. The engine cooling water temperature switch 56 and the accelerator switch 57 have fixed contacts 56a, 57a, respectively, connected to ground level. Movable contacts 56b, 57b of these switches 56, 57 are connected, in negative logic, to the input side of an OR gate or circuit 60. A pair of DC power sources DC5V is connected via resistors to the junctions, respectively, between the engine cooling water temperature switch 56 and the OR circuit 60 and between the accelerator switch 57 and the OR circuit 60. The evaporator outlet switch 58 is disposed adjacent to the outlet of the evaporator 81 and is adapted to be turned on when the pressure Pe of the regrigerant gas at the evaporator outlet exceeds a preset value. The evaporator switch 58 has a grounded fixed contact 58a and a movable contact 58b connected to the input side of a first AND gate or circuit 61.

The internal sensor means 55b comprises a Pc pressure switch 59 disposed in a suitable position which is normally held in communication with the second pressure chambers (Pc chamber) 28a', 28b'. The Pc pressure switch 59 is adapted to be turned on when the pressure Pc in the second pressure chambers 28a', 28b' exceeds a preset value. The Pc pressure switch 59 has a grounded fixed contact 59a and a movable contact 59b connected to the input side of a second AND gate or circuit 62 via a non-illustrated inverter. A pair of DC power sources DC5V is connected via resistors to the junctions, respectively, between the evaporator outlet switch 58 and the first AND circuit 61, and between the Pc pressure switch 59 and the second AND circuit 62.

The controller further includes a control means 63 composed of an oscillator 64, a logic circuit or unit 65, a driver circuit 66, a DC power source DC12V and the DC power sources DC5V. The oscillator 64 produces a pulse signal for enabling the solenoid valve 71 to alternately connecting and blocking flow communication between the low pressure chamber 10 and the high pressure chamber 11. The oscillator 64 is connected to the input side of each of the first and second AND circuits 61, 62.

The logic circuit or unit 65 is composed of the first and second AND circuits 61, 62 and the OR circuit 60. The output sides of the AND circuits 61, 62 are connected to the input side of the OR circuit 60. These circuits 60–62 are provided for controlling the solenoid valve 71 on the basis of the internal and external thermal load conditions detected by the sensor means 55.

The driver circuit 66 includes a first transistor Tr1, a second transistor Tr2, a first resistor R1, a second resistor R2, a third resistor R3, a diode D and a capacitor C.

The DC power source DC12V is connected through the diode D to the collectors of the first and second transistors Tr1, Tr2. The emitter of the first transistor Tr1 is directly connected to the ground level while the emitter of the second transistor Tr2 is grounded via the base of the first transistor Tr1 and the first resistor R1.

The output side of the OR circuit 60 is connected to the base of the second transistor Tr2 via the capacitor C and the second resistor R2 that are connected in parallel relation. The third resistor R3 is connected to the junction between the second transistor Tr2, the capacitor C and the second resistor R2 and also to the junction between the first and second transistor Tr1, Tr2 and further to one terminal of the first resistor R1.

The exciting coil 45 of the solenoid valve 71 has one terminal connected to the junction between the DC power source DC12V and the diode D, the other terminal thereof being connected to the diode D and also to the junction between the first and second transistors Tr1, Tr2.

Operation of the sliding-vane rotary compressor of the foregoing construction is described below in greater detail.

The drive shaft 4 is driven by a vehicle engine to rotate the rotor 1 in the clockwise direction in FIG. 8, whereupon the vanes 8 project radially outwardly from the radial slots 5 due to the centrifugal force and the back pressure acting thereon. With revolution of the rotor 1, the vanes 6 slide along inner wall of the cylinder 1 during which time the compression chambers 8 between the vanes 6 subsequently increase and decrease in size. In the intake stroke in which the compression chambers 8 inceases in size, the refrigerant gas is drawn into the compression chambers 8 from the intake holes 16*a*, 16*b*. In the succeeding compression stroke in which the compression chambers 8 reduces in size, the refrigerant gas is compressed in the compression chambers 8. In the succeeding discharge stroke, the delivery valves 20*a*, 20*b* are forced to open by the pressure of the compressed refrigerant gas, whereupon the refrigerant gas is discharged from the compressor successively through the discharge holes 17*a*, 17*b*, the high pressure chamber 11 and the discharge port 13. The compressed refrigerant gas thus discharged is then circulated through the refrigeration system.

While the compressor is in operation, the pressure in the low pressure chamber 10 is introduced as a low pressure Ps to the first pressure chambers 28*a*, 28*b* through the intake holes 16*a*, 16*b*. At the same time, the pressure in the high pressure chamber 11 is introduced as a high pressure Pd to the second pressure chambers 28*a'*, 28*b'* through the orifice 34. With this arrangement, the pressure-retaining portions 26*a*, 26*b* are subjected concurrently to a first force tending to turn the adjustment member 22 in the direction of the arrow B in FIG. 11 to thereby enlarge the open area of the by-pass ports 70 (the first force is a combination of the pressure in the first pressure chambers 28*a*, 28*b* and the force of the spring 25), and a second force tending to turn the adjustment member 22 in the direction of the arrow A in FIG. 11 to thereby reduce the open area of the by-pass ports 70 (the second force is the pressure in the second pressure chambers 28*a'*, 28*b'*). Consequently, in response to a difference between the first and second forces, the adjustment member 22 is turned in either direction to adjust the open area of the by-pass ports 70, thereby controlling the compression starting timing and hence the displacement of the compressor. The pressure of the first pressure chambers 28*a*, 28*b* and the pressure in the second pressure chambers 28*a'*, 28*b'* are changed by the solenoid valve 71 which is operative to alternately open and close the first high pressure guide passage 32 for making and blocking fluid communication between the low pressure chamber 10 and the second pressure chambers 28*a'*, 28*b'*. With this pressure change, the adjustment member 22 is turned in either direction to thereby vary the open area of the by-pass ports 70. It is therefore apparent that a continuous adjustable control of displacement of the compressor is possible by properly controlling the operation of the solenoid valve 71.

The evaporator outlet switch 58 which is disposed adjacent to the outlet of the evaporator 81 is turned on when the evaporator outlet pressure Pe becomes higher than a preset value such as 2.0 Kg/cm$^2$, for example. In this instance, no output appears on the output side of the first AND circuit 61 of the logic unit 65. Consequently, the driver circuit 66 does not receive any driving signal from the logic unit 65 with the result that the solenoid valve 71 remains in the valve closing position, thereby blocking the first high pressure guide passage 32. The pressure Pd in the high pressure chamber 11 is introduced through the orifice 34 into the second pressure chambers 28*a'*, 28*b'* to increase the pressure Pc in these second chambers. When the pressure Pc exceeds the combined force of the pressure in the first pressure chambers 28*a*, 28*b* and the force of the spring 25, the spring 25 yields up, permitting the adjustment member 22 to turn in the direction of the arrow A in FIG. 11 until the adjustment member 22 assumes its angular position indicated by the phantom lines in which the by-pass ports 70 are fully closed by the adjustment member 22. Under such condition, all amount of the refrigerant gas which has been fed to the compression chambers 8 through the intake holes 16*a*, 16*b* is compressed and then discharged. The compressor is now operating at full power with a maximum displacement.

When the pressure Pc is excessively high such as, for example, greater than 10 kg/cm$^2$, the Pc pressure switch 59 is turned on to produce an on-signal which in turn is inputted, in negative logic, to the second AND circuit 62. Since pulse signals (on-off signal to the solenoid 71) are supplied by the oscillator 64 to the second AND circuit 62, the second AND circuit 62 delivers periodical voltage signals through the OR circuit 60 to the driver circuit 66 as long as the Pc pressure switch 59 is kept in on-stage. The periodical voltage signals thus supplied cause the first and second transistors Tr1, Tr2 to be triggered or turned on correspondingly to thereby alternately energize and de-energize the exciting coil 45. In response thereto, the solenoid valve 71 alternately opens and closes the first high pressure guide passage 32. This enables that the pressure in the second pressure chambers 28*a'*, 28*b'* (i.e., Pc pressure) is relieved toward the low pressure chamber 10 through the first high pressure guide passage 32. Then, the Pc pressure is decreased. When the Pc pressure becomes lower than the preset value such as 10 Kg/cm$^2$, for example, the Pc pressure switch 59 is turned off. Then the off-signal is supplied, in negative logic, to the second AND circuit 62 which in turn terminates supply of the pulse signals to the driver circuit 66 to the oscillator 64. In the absence of the signal supply, the solenoid valve 71 is kept in valve-closing position, thereby blocking the first high pressure guide passage 32.

When the outlet pressure Pe of the evaporator 81 becomes lower than the preset value such as, 2.0 Kg/cm$^2$, for example, the evaporator outlet switch 58 is turned off. So long as the off-stage of the evaporator outlet switch 58 continues, the first AND circuit 61 sends periodical voltage signals through the OR circuit 60 to the driver circuit 66, in synchronism with pulse signals received from the oscillator 64. Upon receipt of the voltage signals, the first and second transistors Tr1, Tr2 are periodically turned on, thereby alternately energizing and de-energizing the exciting coil 45. In response thereto, the solenoid valve 71 alternately opens and closes the first high pressure guide passage 32. This valve operation enables that the Pc pressure in the second pressure chambers 28*a'*, 28*b*, is relieved toward the low pressure side or the low pressure chamber 10. With this pressure relief, the Pc pressure is dropped with the result that the adjustment member 22 is caused to turn in the direction of the arrow B of FIG. 11 until the cut-out recesses 24*a*, 24*b* are brought in registry with the corresponding by-pass ports 70. The by-pass ports 70 are thus opened as indicated by the solid lines in FIG. 11. Consequently, the refrigerant gas which has been introduced through the intake holes 16*a*, 16*b* to the compression chambers 6 is allowed to flow through the by-pass ports 70 into the low pressure chamber 10. With the by-pass ports 70 thus open, the compression starting timing is retarded and hence the amount of refrigerant gas to be trapped in the compression chambers 8 is reduced. The power or displacement of the compressor is therefore reduced.

It appears from the foregoing that a delay in controlling operation is avoidable because the displacement of the compressor is controlled in such a manner that the outlet pressure Pe of the evaporator in the refrigerant cycle is always maintained at the preset value.

The engine cooling water temperature switch 56 is turned on when the engine cooling water becomes hotter than a preset value. As the on-off signals of the engine cooling water temperature switch 56 are inputted, in negative logic, to the OR circuit 60 in the logic unit 65, the OR circuit 60 continuously delivers a voltage signal to the driver circuit 66 so long as the switch 56 is kept in on-stage. In response to the voltage signal thus supplied, the first and second transistors Tr1, Tr2 are turned on to thereby energize the exciting coil 45, whereupon the solenoid valve 71 opens the first high pressure guide passage 32. The Pc pressure is now relieved through the first high pressure guide passage 32 toward the low pressure chamber 10. With this pressure relief, the Pc pressure is dropped and hence the compression starting timing is retarded in the same manner as demonstrated when the evaporator outlet switch 58 is turned off. As a result, the displacement of the compressor is reduced and engine load is also reduced correspondingly. With this load reduction, it is possible to avoid an engine overheating.

In case the temperature of engine cooling water is lower than the preset value, the engine cooling water temperature switch 56 is turned off. Since the off-signal of the switch 56 is delivered, in negative logic, to the OR circuit 60, the OR circuit 60 does not supply a voltage signal to the driver circuit 66 so long as the switch 56 is kept in off-stage. Under such condition, the solenoid valve 71 keeps the first high pressure guide passage 32 in blocked condition.

The accelerator switch 57 is turned on when the depression or step-in angle exceeds a preset value. Since signals from the accelerator switch 57 is delivered, in negative logic, to the OR circuit 60 in the logic unit 65, the OR circuit 60 continuously sends voltage signals to the driver circuit 66 so long as the accelerator switch 57 is kept in on-stage. In this condition, the first and second transistors Tr1, Tr2 are turned on to thereby energize the exciting coil 45. Upon energization of the coil 45, the solenoid valve 71 opens the first high pressure guide passage 32, whereupon the Pc pressure is relieved through the first high pressure guide passage 32 towards the low pressure chamber 10. This pressure relief lowers the Pc pressure. Further, with the first high pressure guide passage 32 thus opened, the compression starting timing is retarded correspondingly and hence the amount of refrigerant gas to be trapped in the compression cambers 8 is also reduced, in the same manner as experienced when the evaporator outlet switch 58 is turned off. Since the displacement of the compressor is reduced, the engine load is also reduced. This is advantageous in that part of the engine power which is corresponding to the reduced engine load can be used for cruising of the vehicle.

When the accelerator depression angle is smaller than the preset value, the accelerator switch 57 is turned off. So long as such off-stage of the accelerator switch 57 continues, the OR circuit 60 does not issue a voltage signal to the driver circuit 66. Thus, the solenoid valve 71 keeps the first high pressure guide passage 32 in blocked condition.

Figure 13:
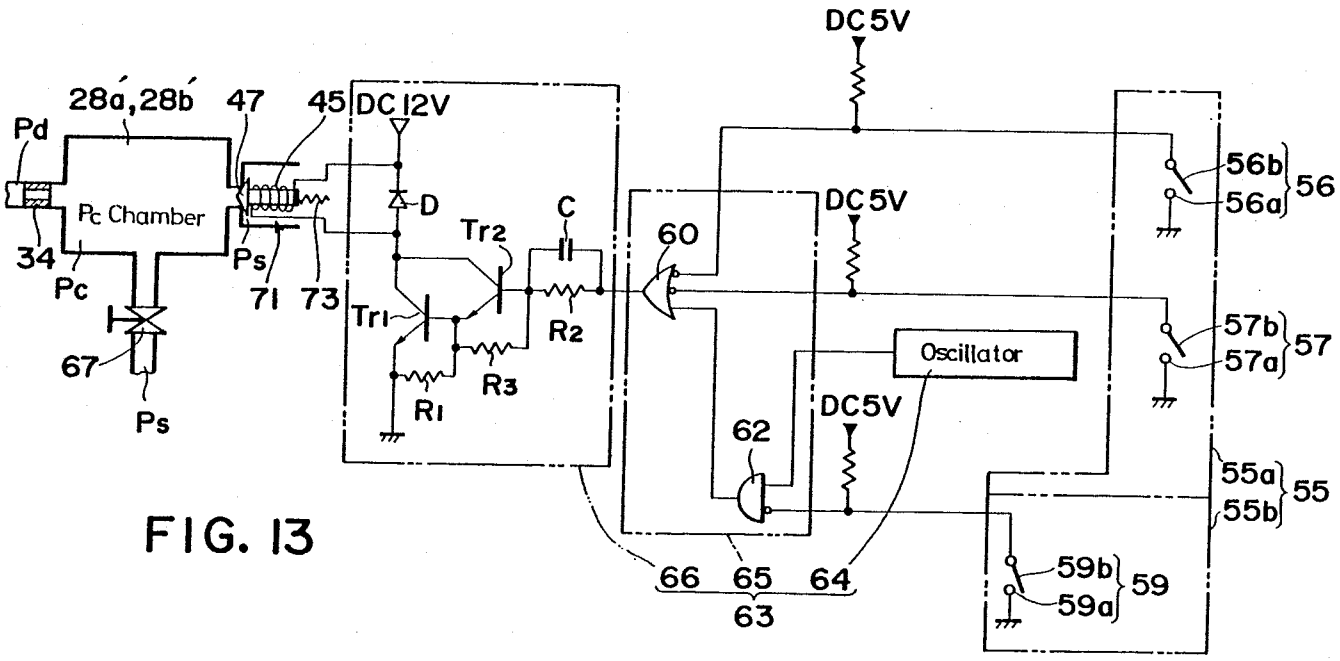
FIG. 13 is a block diagram showing a controller according to another embodiment.

FIG. 13 shows a modified apparatus for controlling variable displacement compressor according to another embodiment. The controller is substantially identical with the controller of the foregoing embodiment with the exception that the evaporator outlet switch 58 as required in the foregoing embodiment is omitted for reduced cost, and a control valve 67 with a pressure responsive bellows is provided. With the controller thus constructed, the control of displacement of the compressor is effected basically internally by the bellows-actuated control valve 67 but partly externally by an electric circuit incorporating the switch 58.

Other structural details and function of the controller are the same as those of the controller shown in FIG. 12 and a description is not necessary. With this similarlity in view, the same or corresponding parts are indicated by the same reference characters throughout FIGS. 12 and 13.

Although the foregoing embodiments are described with respect to sliding-vane rotary compressors, the present invention is not limited to such embodiment. Rather, the invention is also useful when embodied in a compressor of different type.

Further, in place of the oscillator 64, a duty ratio control system may be used. The duty ratio control system is operative in response to the pressure Ps of the lower pressure side which varies in the range of 1.7–2.0 Kg/cm$^2$. As the pressure Ps becomes close to 1.7 kg/cm$^2$, the opening period of the solenoid valve 71 is elongated to nearly 100%, thereby operating the compressor at a reduced power. On the contrary, when the intake pressure Ps becomes equal to 2.0 kg/cm$^2$, the valve opening time is reduced to 0%, thereby operating the compressor at full power.

Although the sensor means 55 in the illustrated embodiments comprises the engine cooling water temperature switch 56, the accelerator switch 57, the evaporator outlet switch 58, and the Pc pressure switch 59, the present invention is not limited to these switches. Rather, it is possible to omit or modify any one of these switches. Addition of other sensors is also possible.

Obviously, many modification and variations of the present invention are possible in the light of the above teachings. It is therefore to be understood that within the scope of the appended claims, the invention may be practiced otherwise than as specifically described.

What is claimed is:

1. A sliding-vane rotary compressor including a displacement-adjusting mechanism, said compressor comprising:

(a) a rotor slidably carrying thereon a plurality of radial vanes and rotatably disposed in a space defined by a cylinder and a pair of side blocks disposed on opposite ends of said cylinder;

(b) means defining a plurality of compression chambers which are variable in volume with each revolution of said rotor, said chamber-defining means including said cylinder, rotor, side blocks and plurality of radial vanes, and said compression chambers being defined by said cylinder, rotor, side blocks and vanes;

(c) an adjustment member rotatably disposed in one of said side blocks for adjusting a compression starting position;

(d) resilient means for urging said adjustment member to turn in one direction;

(e) means defining a pressure chamber communicating with a high pressure chamber through an orifice for producing a pressure acting on said adjustment member for urging said adjustment member in the opposite direction against the force of said resilient means;

(f) a first control valve, said first control valve including a bellows and being operative in response to the pressure in a low pressure chamber for adjusting the rate of communication between said pressure chamber and said low pressure chamber; and (g) a second control valve, said second control valve including a solenoid valve and being operative in response to an external signal of the type representing the rate of acceleration of a vehicle for adjusting the rate of communication between said pressure chamber and said low pressure chamber.

2. A sliding-vane rotary compressor according to claim 1, wherein said second control valve is operative in response to an external signal of the type representing the temperature of outside air.

3. A sliding-vane rotary compressor according to claim 1, wherein said second control valve is operative in response to an external signal of the type representing the temperature of a vehicle compartment.

4. An apparatus for controlling a sliding-vane variable displacement rotary compressor comprising:

(a) electric on-off means, and said electric on-off means including a solenoid valve for selectively blocking the communication between a low pressure chamber and a high pressure chamber in a sliding-vane rotary compressor;

(b) sensor means for detecting internal and external thermal load conditions for controlling operation of the sliding-vane rotary compressor, said sensor means including a first pressure switch operative in response to the pressure in the low pressure chamber, and said sensor means including a second pressure switch operative in response to the pressure in the outlet of an evaporator for controlling the capacity of the sliding-vane rotary compressor for varying the cooling capability of the evaporator; and (c) control means for controlling operation of said electric on-off means on the basis of the internal and external thermal load conditions detected by said sensor means.

5. An apparatus according to claim 4, said sensor means including a temperature switch operative in response to the temperature of engine cooling water.

6. An apparatus according to claim 4, said sensor means including an accelerator switch operative in response to the depressing angle of an accelerator pedal.

* * * * *